US007091984B1

(12) United States Patent
Clark

(10) Patent No.: US 7,091,984 B1
(45) Date of Patent: Aug. 15, 2006

(54) SCALABLE DESKTOP

(75) Inventor: Richard L. Clark, Kirkland, WA (US)

(73) Assignee: NVIDIA Corporation, Santa Clara, CA (US)

( * ) Notice: Subject to any disclaimer, the term of this patent is extended or adjusted under 35 U.S.C. 154(b) by 99 days.

(21) Appl. No.: 10/798,521

(22) Filed: Mar. 11, 2004

(51) Int. Cl.
*G09G 5/00* (2006.01)

(52) U.S. Cl. ..... 345/587; 345/427; 345/660; 345/664

(58) Field of Classification Search ..... 345/427, 345/582, 660, 664, 587; 715/782
See application file for complete search history.

(56) References Cited

U.S. PATENT DOCUMENTS 5,255,352 A * 10/1993 Falk ..... 345/582
5,678,015 A * 10/1997 Goh ..... 715/782
6,229,542 B1 * 5/2001 Miller ..... 715/782
6,597,358 B1 * 7/2003 Miller ..... 345/427
2002/0154132 A1 * 10/2002 Dumesny et al. ..... 345/582

OTHER PUBLICATIONS

MSDN Microsoft Library "Direct3D Textures" Apr. 2005 <http://msdn.microsoft.com/library/default.asp?url=/library/en-us/directx9_c/directx/graphics/ProgrammingGuide/GettingStarted/Direct3DTextures/Direct3DTextures.asp>.

* cited by examiner

*Primary Examiner*—Kee M. Tung
*Assistant Examiner*—Mike Rahmjoo
(74) *Attorney, Agent, or Firm*—Patterson & Sheridan, L.L.P.

(57) ABSTRACT

A method for displaying a desktop display surface. The method includes creating a render target surface having substantially the same dimensions as a desktop display surface, casting the desktop display surface as a texture, and setting the render target surface as a scanout read location. The method further includes creating a two dimensional rectangular object, rendering the two dimensional rectangular object by mapping the desktop display surface texture to the two dimensional rectangular object, storing the rendered two dimensional rectangular object to the render target surface and scanning out the rendered two dimensional rectangular object from the render target surface.

22 Claims, 6 Drawing Sheets

SCALABLE DESKTOP

CROSS-REFERENCE TO RELATED APPLICATIONS

This application is related to the commonly assigned co-pending U.S. patent application Ser. No. 10/185,764, entitled "METHOD AND APPARATUS FOR DISPLAY IMAGE ADJUSTMENT", filed Jun. 27, 2002, which is incorporated herein by reference.

BACKGROUND OF THE INVENTION

1. Field of the Invention

Embodiments of the present invention generally relate to a method for displaying an image, and more particularly, to a method for displaying a scalable image.

2. Description of the Related Art

Many computer programs provide a feature for zooming in and out of an image. Examples of such computer programs include Adobe Acrobat, MapQuest, Microsoft Word and many others. When a user wants to see a larger version of the image displayed on a computer screen, the user simply selects a scale up or zooming feature. Likewise, when the user wants to reduce the image, the user simply selects a scale down feature. However, this scale up and scale down feature are limited to the specific application or program.

Therefore, a need exists in the art for a method of scaling up or scaling down an image without being limited to any specific application.

SUMMARY OF THE INVENTION

Embodiments of the present invention are generally directed to a method for displaying a desktop display surface. The method includes creating a render target surface having substantially the same dimensions as a desktop display surface, casting the desktop display surface as a texture, and setting the render target surface as a scanout read location.

In one embodiment, the method further includes creating a two dimensional rectangular object and rendering the two dimensional rectangular object by mapping the desktop display surface texture to the two dimensional rectangular object.

In another embodiment, the method further includes storing the rendered two dimensional rectangular object to the render target surface and scanning out the rendered two dimensional rectangular object from the render target surface.

In yet another embodiment, the method further includes receiving a zoom factor, an offset in the x direction and an offset in the y direction; calculating a texture addressing extent configured to determine an amount of the desktop display surface texture to be mapped to the two dimensional rectangular object; and calculating a set of texture addressing offsets in the x and y directions configured to provide the position on the desktop display surface texture from which the desktop display surface texture is to be mapped to the two dimensional rectangular object.

In still another embodiment, the method further includes calculating the texture addressing coordinates (u, v) as a function of the texture addressing extent and the texture addressing offsets in the x and y directions.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
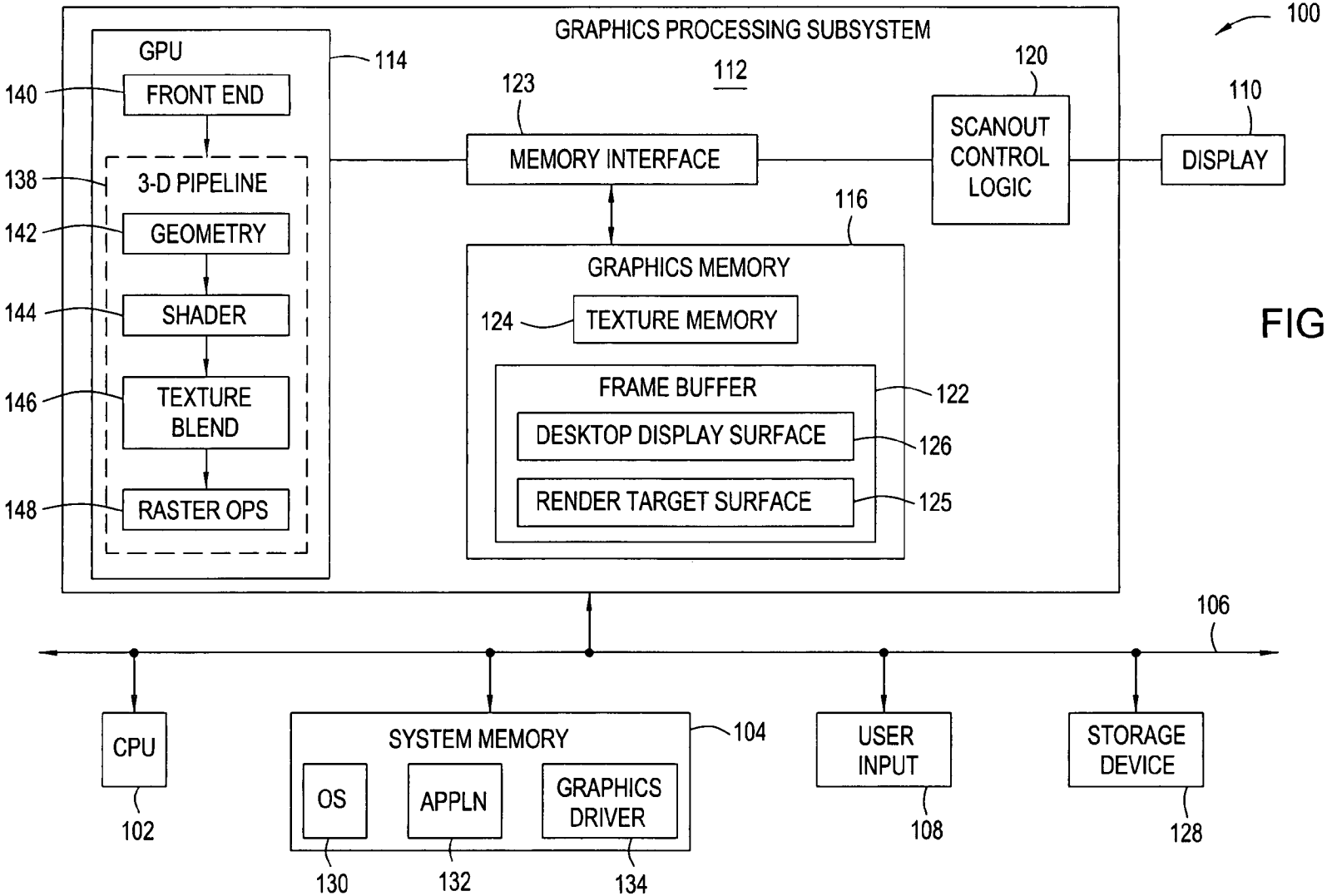
FIG. 1 illustrates a simplified block diagram of a computer system 100 according to an embodiment of the present invention.

FIG. 1 illustrates a simplified block diagram of a computer system 100 according to an embodiment of the present invention. The computer system 100 includes a central processing unit (CPU) 102 and a system (or main) memory 104 communicating via a bus 106. User input is received from one or more user input devices 108 (e.g., keyboard, mouse) coupled to the bus 106. Visual output is provided on a pixel based display device 110 (e.g., a conventional CRT or LCD based monitor, projector, etc.) operating under control of a graphics processing subsystem 112 coupled to the bus 106. Other components, such as one or more storage devices 128 (e.g., a fixed or removable magnetic disk drive, compact disk (CD) drive, and/or DVD drive), may also be coupled to the system bus 106.

The graphics processing subsystem 112 includes a graphics processing unit (GPU) 114, a graphics memory 116, and a scanout control logic 120, which may be implemented, e.g., using one or more integrated circuit devices. The graphics memory 116 includes a frame buffer 122 and a texture memory 124. The frame buffer 122 stores pixel data to be read by the scanout control logic 120 and transmitted to the display device 110 for display as an image. In accordance with one embodiment of the invention, the frame buffer 122 includes a desktop display surface 126 and a render target surface 125. A detailed description of the desktop display surface 126 and the render target surface 125 is provided in the paragraphs below with reference to FIGS. 2–6.

The texture memory 124 stores data for one or more textures to be used during generation of pixel data. A memory interface 123 is provided to manage communication between the graphics memory 116 and other system components. The memory interface 123 may be integrated with the graphics memory 116 or provided as a separate integrated circuit device.

The GPU 114 includes various components for receiving and processing graphics system commands received via the bus 106. The GPU 114 may include a front end module 140 and a three-dimensional (3-D) processing pipeline 138 for rendering images, i.e., generating pixel data to be displayed on the display device 110 from 3-D graphics data (e.g., geometry data including polygons and related data describing a scene) received via the bus 106. The GPU 114 may also include a separate two-dimensional (2-D) processing pipeline (not shown) for rendering images using 2-D graphics data received from the CPU 102.

As mentioned above, the 3-D pipeline 138 is generally used for image rendering. The pipeline 138 may contain various processing modules, such as a geometry processing module 142, a shader 144, a texture blending module 146, and a raster operations module 148, all of which are usable to convert 3-D graphics data into pixel data suitable for displaying on the display device 110. The 3-D pipeline 138 may be controllable by application programs invoking API functions supported by the graphics driver 134 as further described below.

The computer system 100 further includes a system memory 104, which stores operating system programs 130 for generating pixel and/or graphics data to be processed by the graphics processing subsystem 112. Examples of operating system programs 130 include Graphical Device Interface (GDI) component of the Microsoft Windows operating system. The system memory 104 further stores a graphics driver program 134 for enabling communication with the graphics processing subsystem 112. The graphics driver program 134 implements one or more standard application program interfaces (APIs), such as Open GL, Microsoft DirectX, or D3D for communication with the graphics processing subsystem 112. By invoking appropriate API function calls, the operating system programs 130 are able to instruct the graphics driver program 134 to transfer graphics data or pixel data to the graphics processing subsystem 112 via the system bus 106 and invoke various rendering functions of the GPU 114. Data transfer operations may be performed using conventional DMA (direct memory access) or other operations. The specific commands transmitted to the graphics processing subsystem 112 by the graphics driver 134 in response to an API function call may vary depending on the implementation of the GPU 114, and these commands may include commands implementing additional functionality (e.g., special visual effects) not controlled by the operating system programs 130.

The system memory 104 further stores various software applications, such as scalable desktop software 132 in accordance with embodiments of the present invention. A detailed description of the operations of the scalable desktop software 132 is provided in the paragraphs below with reference to FIGS. 2–6.

It will be appreciated that the computer system 100 is illustrative and that variations and modifications are possible. The computer system 100 may be a desktop computer, server, laptop computer, palm-sized computer, tablet computer, game console, set-top box, personal digital appliance, tethered Internet appliance, portable gaming system, cellular/mobile telephone, computer based simulator, or the like. The display device 110 can be any pixel-based display, e.g., a CRT or LCD monitor, projector, printer, etc. In some instances, multiple display devices (e.g., an array of projectors or CRT monitors) may be supported, with each device displaying a portion of the image data. The GPU 114 may implement various pipelines for processing 3-D and/or 2-D graphics data, and numerous techniques may be used to support data transfers between the system memory 104 and the graphics memory 116. The GPU 114 or any of its components may be implemented using one or more programmable processors programmed with appropriate software, application specific integrated circuits (ASICs), other integrated circuit technologies, or any combination of these. The graphics memory 116 may be implemented using one or more memory devices. The memory interface 123 may be integrated with the graphics memory 116 and/or the GPU 114, or implemented in one or more separate devices, e.g., ASICs. The scanout control logic 120 may be implemented in the same device (e.g., programmable processor) as the GPU 114 or a different device. In view of the present disclosure, persons of ordinary skill in the art will recognize that the present invention can be embodied in a wide variety of system configurations.

Figure 2:
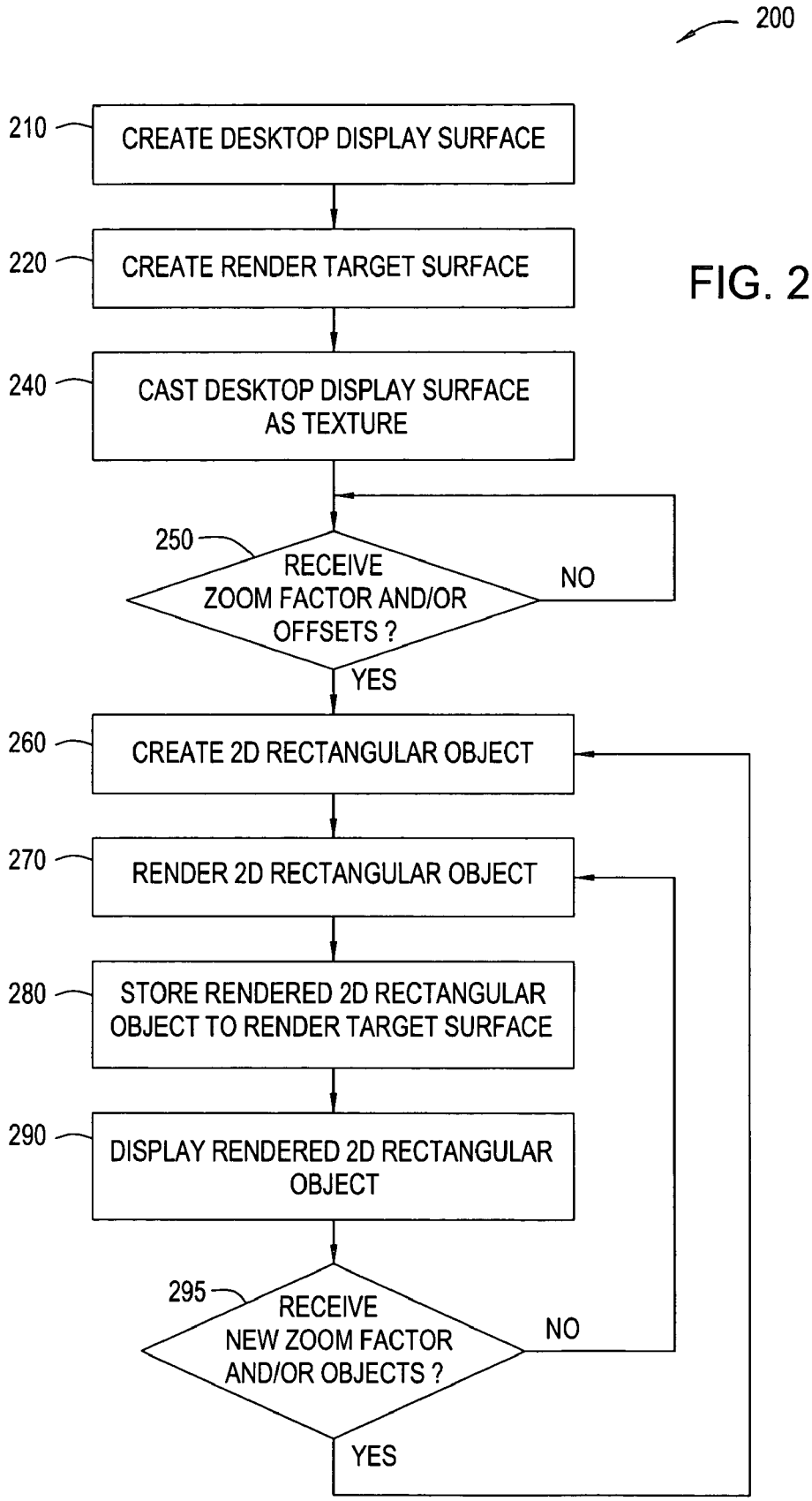
FIG. 2 illustrates a flow diagram of a method for scaling a desktop display surface in accordance with one embodiment of the invention.
Figure 3:
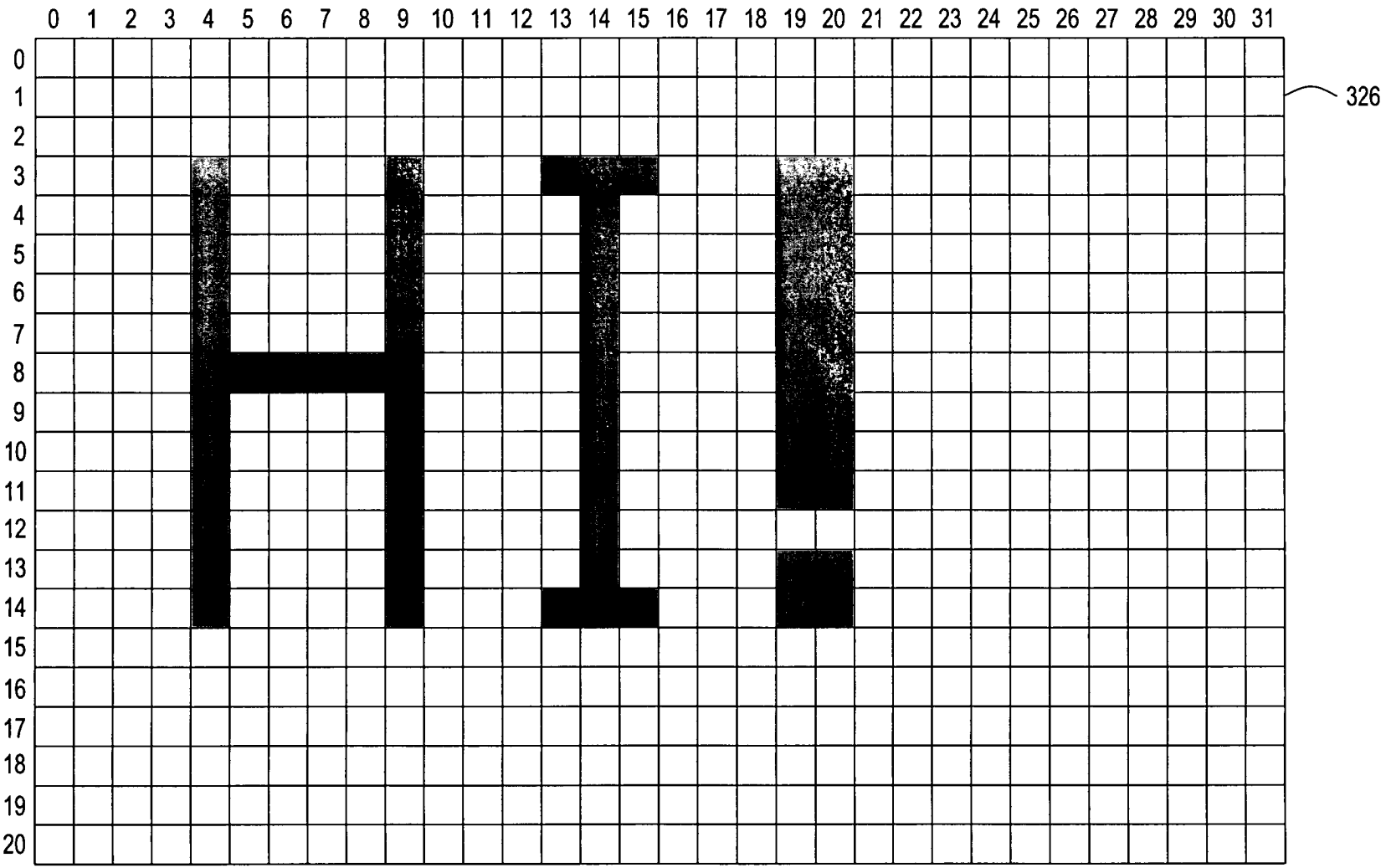
FIG. 3 illustrates a desktop display surface in accordance with one embodiment of the invention.
Figure 4:
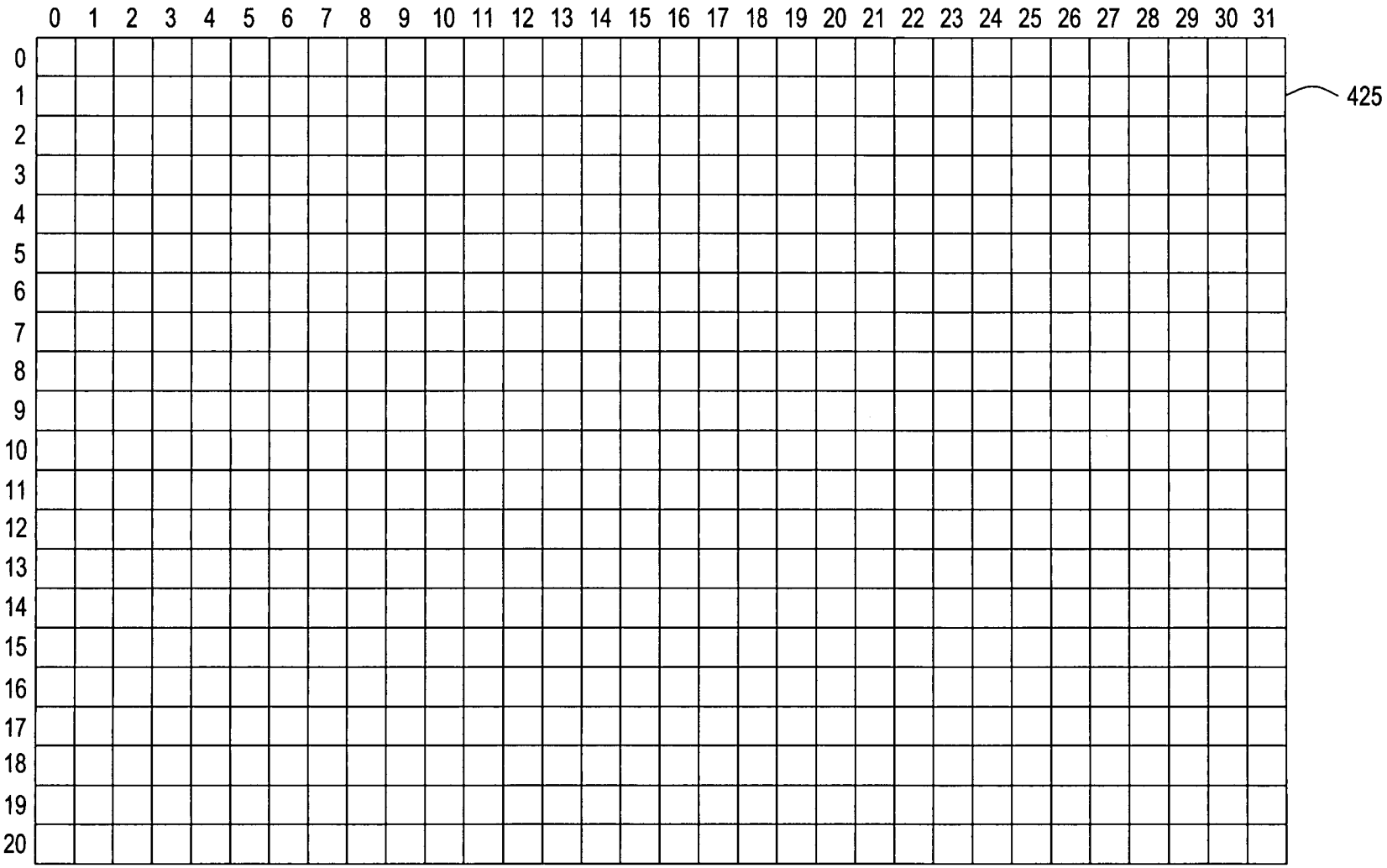
FIG. 4 illustrates a render target surface having substantially the same dimensions as the desktop display surface illustrated on FIG. 3 in accordance with one embodiment of the invention.

FIG. 2 illustrates a flow diagram of a method 200 for scaling a desktop display surface in accordance with one embodiment of the invention. At step 210, a desktop display surface 126 is created inside the frame buffer 122. The desktop display surface 126 may be a Microsoft Windows desktop display surface. The desktop display surface 126 is generally created by the GPU 114. For purposes of illustrating the invention, a desktop display surface 326 is illustrated on FIG. 3. The desktop display surface 326 has dimensions of 32 by 21 pixels. Although the desktop display surface 326 is illustrated as having dimensions of 32 by 21 pixels, various embodiments of the invention described herein are not limited by the dimensions used for purposes of illustrating the invention.

At step 220, a render target surface 125 is created inside the frame buffer 122. The render target surface 125 may be the same size as, or larger than, the desktop display surface 126. The render target surface 125 may be created using a DirectX API call. For purposes of illustrating the invention, a render target surface 425 is illustrated on FIG. 4. The render target surface 425 has substantially the same dimensions as the desktop display surface 326.

At step 240, the desktop display surface 126 is cast as a texture. That is, the cast converts the desktop display surface 126 into a texture.

Once the render target surface 125 is created and the desktop display surface 126 is cast as a texture, then a determination is made as to whether a zoom factor, an offset in the x direction, and an offset in the y direction have been received (step 250). The zoom factor and the offset information may be received through an input device, such as a keyboard, a mouse and the like. The offsets may be in terms of pixels. For purposes of illustrating the invention, the zoom factor is three, the offset in the x direction is four pixels and the offset in the y direction is three pixels.

If the answer is in the affirmative, then processing continues to step 260 at which a two dimensional rectangular object is created. In creating the two dimensional rectangular object, four or more vertices of the two dimensional rectangular object are determined. In one embodiment, the vertices are positioned on the upper left hand corner, the upper right hand corner, the bottom right hand corner and the bottom left hand corner of the two dimensional rectangular object. In another embodiment, the two dimensional rectangular object has 256 vertices.

Each vertex generally has five coordinates, i.e., x, y, z, u and v. X and y generally refer to the location of that vertex with respect to the x and y dimensions of the display area. For purposes of illustrating the invention, for a 32 by 21 display area, the (x, y) coordinates for the upper left hand corner vertex are (0, 0). The (x, y) coordinates for the upper right hand corner vertex are (32, 0). The (x, y) coordinates for the lower left hand corner vertex are (0, 21). The (x, y) coordinates for the lower right hand corner vertex are (32, 21). Z refers to the depth coordinate of a vertex. For a two dimensional object, z is set to a constant value. U and v refer to the texture addressing coordinates, which are typically normalized to be in the range from 0 to 1.

The texture addressing coordinates (u, v) are configured to control how the desktop display surface texture is to be mapped to the two dimensional rectangular object. The texture addressing coordinates (u, v) are a function of a texture addressing extent, a texture addressing offset in the x direction, and a texture addressing offset in the y direction. The texture addressing extent provides the amount of the desktop display texture to be mapped to the two dimensional rectangular object. The texture addressing extent is calculated as the texture address range divided by the zoom factor. In a case of texture addressing coordinates normalized to a texture address range of 0 to 1, the texture addressing extent is equal to (1−0)/zoom factor (or the inverse of the zoom factor). For purposes of illustration, since the zoom factor is three, the texture addressing extent is 0.333.

The texture addressing offsets in the x and y directions provide the position on the desktop display texture from which the desktop display texture is to be mapped to the two dimensional rectangular object. The texture addressing offset in the x direction is calculated as the offset in the x direction (received at step 250) divided by the number of pixels in the x direction of the display area. The texture addressing offset in the y direction is calculated as the offset in the y direction (received at step 250) divided by the number of pixels in the y direction of the display area. For purposes of illustration, since the offset in the x direction is four pixels and the offset in the y direction is three pixels, then the texture addressing offset in the x direction is $4/32$ (or 0.125) and the texture addressing offset in the y direction is $3/21$ (or 0.143) for a 32 by 21 display area.

Once the texture addressing extent and the texture addressing offsets are determined, then the texture addressing coordinate u for the upper left hand corner of the two dimensional rectangular object is set to be equal to the texture addressing offset in the x direction, while the texture addressing coordinate v for the upper left hand corner of the two dimensional rectangular object is set to be equal to the texture addressing offset in the y direction. Following along the illustration given above, the texture addressing coordinates (u, v) for the upper left hand corner of the two dimensional rectangular object is (0.125, 0.143).

The texture addressing coordinate u for the upper right hand corner of the two dimensional rectangular object is set to be equal to the texture addressing offset in the x direction plus the texture addressing extent, while the texture addressing coordinate v for the upper right hand corner of the two dimensional rectangular object is set to be equal to the texture addressing offset in the y direction. Following along the illustration given above, the texture addressing coordinate u for the upper right hand corner of the two dimensional rectangular object is 0.125 plus 0.333, which is equal to 0.458. The texture addressing coordinate v for the upper right hand corner of the two dimensional rectangular object is 0.143. Thus, the texture addressing coordinates (u, v) for the upper right hand corner of the two dimensional rectangular object is (0.458, 0.143).

The texture addressing coordinate u for the bottom left hand corner of the two dimensional rectangular object is set to be equal to the texture addressing offset in the x direction, while the texture addressing coordinate v for the bottom left hand corner of the two dimensional rectangular object is set to be equal to the texture addressing offset in the y direction plus the texture addressing extent. Following along the illustration given above, the texture addressing coordinate u for the bottom left hand corner of the two dimensional rectangular object is 0.125. The texture addressing coordinate v for the bottom left hand corner of the two dimensional rectangular object is 0.143 plus 0.333, which is equal to 0.476. Thus, the texture addressing coordinates (u, v) for the bottom left hand corner of the two dimensional rectangular object is (0.125, 0.476).

Figure 5:
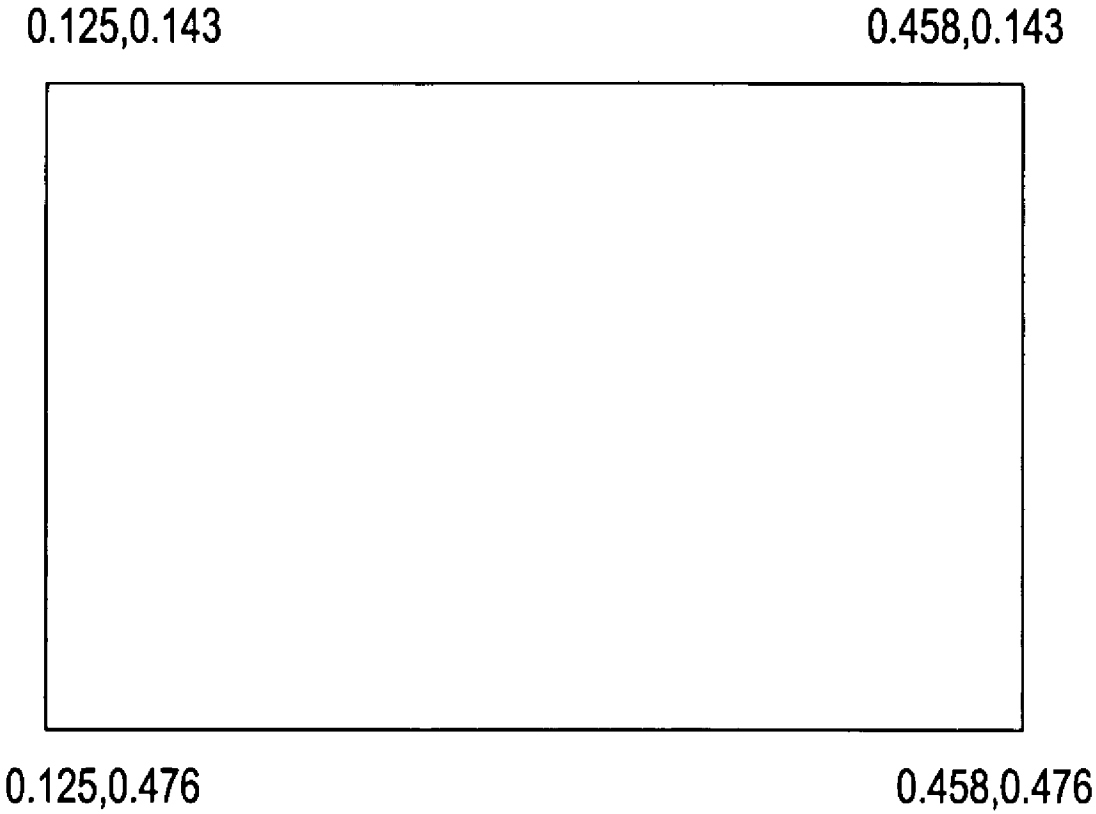
FIG. 5 illustrates a set of texture addressing coordinates (u, v) for each corner of the two dimensional rectangular object in accordance with one embodiment of the invention.

The texture addressing coordinate u for the bottom right hand corner of the two dimensional rectangular object is set to be equal to the texture addressing offset in the x direction plus the texture addressing extent, while the texture addressing coordinate v for the bottom right hand corner of the two dimensional rectangular object is set to be equal to the texture addressing offset in the y direction plus the texture addressing extent. Following along the illustration given above, the texture addressing coordinate u for the bottom right hand corner of the two dimensional rectangular object is 0.125 plus 0.333, which is equal to 0.458. The texture addressing coordinate v for the bottom right hand corner of the two dimensional rectangular object is 0.143 plus 0.333, which is equal to 0.476. Thus, the texture addressing coordinates (u, v) for the bottom right hand corner of the two dimensional rectangular object is (0.458, 0.476). The texture addressing coordinates (u, v) for each corner of the two dimensional rectangular object are illustrated in FIG. 5.

In this manner, the coordinates for the vertices positioned on the upper left hand corner, the upper right hand corner, the bottom right hand corner and the bottom left hand corner of the two dimensional rectangular object are determined. The rest of the vertices on the two dimensional rectangular object may be determined by interpolating the texture addressing coordinates (u, v) and the (x, y) coordinates of the vertices on the upper left hand corner, the upper right hand corner, the bottom right hand corner and the bottom left hand corner of the two dimensional rectangular object. At the end of step 260, a two dimensional rectangular object is created with vertices that correspond with an area of the desktop display surface texture that will be mapped to the two dimensional rectangular object. The coordinates of the vertices are computed as a function of the zoom factor and the offsets received at step 250.

Figure 6:
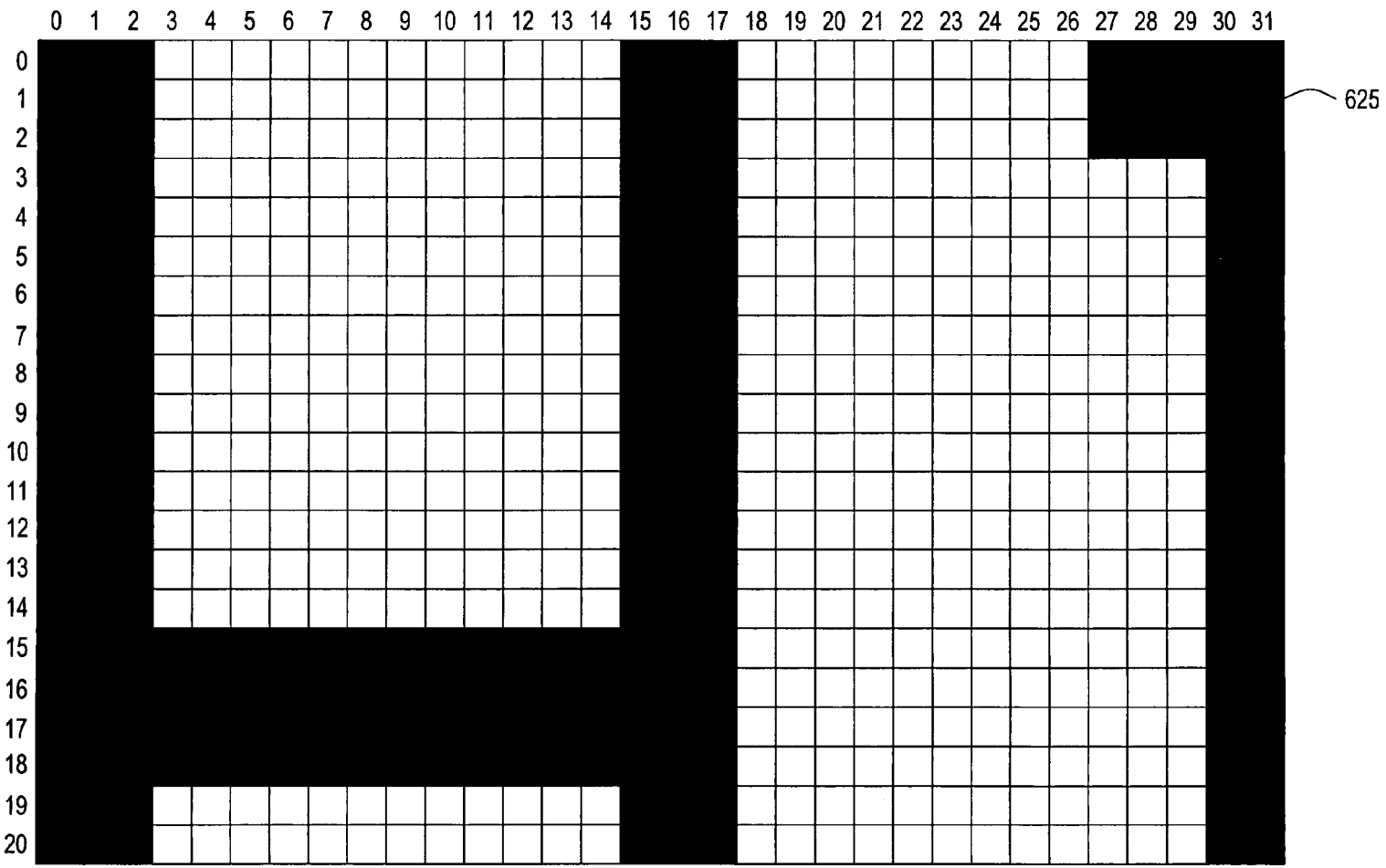
FIG. 6 illustrates a rendered two dimensional rectangular object according to one embodiment of the invention.

At step 270, the two dimensional rectangular object is rendered by mapping the desktop display surface texture (from step 240) to the two dimensional rectangular object, thereby creating a rendered two dimensional rectangular object. The two dimensional rectangular object may be rendered using an API, such as DirectX command, OpenGL and the like. At step 280, the rendered two dimensional rectangular object is stored in the render target surface 125. Following along the illustration given above, the rendered two dimensional rectangular object 625 is illustrated in FIG. 6. Notably, the desktop display surface 326 (shown in FIG. 3) is zoomed or scaled up according to the zoom factor of three, an offset in the x direction of four pixels and an offset in the y direction of three pixels.

At step 290, the scanout read location is set to read from the render target surface 125. The scanout read location may be set by the graphics driver 134 in response to receiving commands from the scalable desktop software 132. The scanout control logic 120 then reads the rendered two dimensional rectangular object from the render target surface 125 and transmits the rendered two dimensional rectangular object to the display device 110 for display.

At step 295, a determination is made as to whether a new zoom factor or offsets have been received. If the answer is in the affirmative, then processing returns to step 260 at which another two dimensional rectangular object is created with a new set of vertices according to the new zoom factor and/or offsets. However, if the answer is in the negative, then processing returns to step 270 at which the same two dimensional rectangular object is rendered again.

While the foregoing is directed to embodiments of the present invention, other and further embodiments of the invention may be devised without departing from the basic scope thereof, and the scope thereof is determined by the claims that follow.

What is claimed is:

1. A method for displaying a desktop display surface having dimensions, comprising:

creating a render target surface having substantially the same dimensions as the desktop display surface; casting the desktop display surface as a texture having the same dimensions as the desktop display surface; determining a set of vertices that define a two dimensional rectangular object having the same dimensions as the desktop display surface; rendering the two dimensional rectangular object by mapping at least a portion of the desktop display surface texture to the two dimensional rectangular object; receiving a zoom factor, an offset in an x direction and an offset in a y direction; calculating a texture addressing extent configured to determine the portion of the desktop display surface texture to be mapped to the two dimensional rectangular object; calculating a set of texture addressing offsets in the x and y directions configured to provide the position on the desktop display surface texture from which the desktop display surface texture is to be mapped to the two dimensional rectangular object, wherein the texture addressing offset in the x direction is calculated as the offset in the x direction divided by the dimension of the desktop display surface in the x direction and the texture addressing offset in the y direction is calculated as the offset in the y direction divided by the dimension of the desktop display surface in the y direction; and setting the render target surface as a scanout read location in preparation for displaying the desktop display surface.

2. The method of claim 1, further comprising storing the rendered two dimensional rectangular object to the render target surface.

3. The method of claim 1, further comprising:

storing the rendered two dimensional rectangular object to the render target surface; and scanning out the rendered two dimensional rectangular object from the render target surface.

4. The method of claim 1, further comprising:

receiving a zoom factor and one or more offsets; and creating the two dimensional rectangular object according to the dimensions of the desktop display surface, the zoom factor and the one or more offsets.

5. The method of claim 1, further comprising:

receiving a zoom factor and one or more offsets; and calculating the texture addressing coordinates (u, v) of each vertex in the set of vertices as a function of the dimensions of the desktop display surface, the zoom factor and the offsets.

6. The method of claim 1, further comprising:

receiving a zoom factor and one or more offsets; and calculating a texture addressing extent configured to determine the portion of the desktop display surface texture to be mapped to the two dimensional rectangular object.

7. The method of claim 6, wherein the texture addressing extent is equal to a texture addressing range divided by the zoom factor.

8. The method of claim 6, wherein the texture addressing extent is equal to a dimension of the desktop display surface divided by the zoom factor.

9. The method of claim 1, wherein creating the two dimensional rectangular object comprises:

setting a texture addressing coordinate u for an upper left hand corner of the two dimensional rectangular object to be equal to the texture addressing offset in the x direction; and setting a texture addressing coordinate v for the upper left hand corner of the two dimensional rectangular object to be equal to the texture addressing offset in the y direction.

10. The method of claim 1, wherein creating the two dimensional rectangular object comprises:

setting a texture addressing coordinate u for an upper right hand corner of the two dimensional rectangular object to be equal to the texture addressing offset in the x direction plus the texture addressing extent; and setting a texture addressing coordinate v for the upper right hand corner of the two dimensional rectangular object to be equal to the texture addressing offset in the y direction.

11. The method of claim 1, wherein creating the two dimensional rectangular object comprises:

setting a texture addressing coordinate u for a bottom left hand corner of the two dimensional rectangular object to be equal to the texture addressing offset in the x direction; and setting a texture addressing coordinate v for the bottom left hand corner of the two dimensional rectangular object to be equal to the texture addressing offset in the y direction plus the texture addressing extent.

12. The method of claim 1, wherein creating the two dimensional rectangular object comprises:

setting a texture addressing coordinate u for a bottom right hand corner of the two dimensional rectangular object to be equal to the texture addressing offset in the x direction plus the texture addressing extent; and setting a texture addressing coordinate v for the bottom right hand corner of the two dimensional rectangular object to be equal to the texture addressing offset in the y direction plus the texture addressing extent.

13. A method for displaying a desktop display surface, comprising:

receiving a zoom factor, an offset in an x direction and an offset in a y direction on the desktop display surface; creating a two dimensional rectangular object having dimensions equal to dimensions of the desktop display surface; computing a set of texture addressing coordinates for the two dimensional rectangular object using the dimensions of the desktop display surface, zoom factor, the offset in the x direction and the offset in the y direction; casting a desktop display surface as a texture having dimensions equal to dimensions of the desktop display surface; a rendering the two dimensional rectangular object by mapping at least a portion of the desktop display surface texture to the two dimensional rectangular object and calculating a texture addressing extent configured to determine the portion of the desktop display surface texture to be mapped to the two dimensional rectangular object; and calculating a set of texture addressing offsets in the x and y directions configured to provide the position on the desktop display surface texture from which the desktop display surface texture is to be mapped to the two dimensional rectangular object, wherein the texture addressing offset in the x direction is calculated as the offset in the x direction divided by the dimension of the desktop display surface in the x direction and the texture addressing offset in the y direction is calculated as the offset in the y direction divided by the dimension of the desktop display surface in the y direction.

14. The method of claim 13, further comprising storing the rendered two dimensional rectangular object to a render target surface having substantially the same dimensions as the desktop display surface.

15. The method of claim 14, further comprising scanning out the rendered two dimensional rectangular object from the render target surface.

16. The method of claim 13, wherein the set of texture addressing coordinates includes texture addressing coordinates (u, v) for an upper right hand corner, an upper left hand corner, a bottom left hand corner and a bottom right hand corner of the two dimensional rectangular object.

17. The method of claim 13, wherein computing a set of texture addressing coordinates for the two dimensional rectangular object comprises:

setting a texture addressing coordinate u for an upper left hand corner of the two dimensional rectangular object to be equal to the offset in the x direction divided by the dimension of the desktop display surface in the x direction; and setting a texture addressing coordinate v for the upper left hand corner of the two dimensional rectangular object to be equal to the offset in the y direction divided by the dimension of the desktop display surface in the y direction.

18. The method of claim 13, wherein computing a set of texture addressing coordinates for the two dimensional rectangular object comprises:

setting a texture addressing coordinate u for an upper right hand corner of the two dimensional rectangular object to be equal to the offset in the x direction divided by the dimension of the desktop display surface in the x direction plus the inverse of the zoom factor; and setting a texture addressing coordinate v for the upper right hand corner of the two dimensional rectangular object to be equal to the offset in the y direction divided by the dimension of the desktop display surface in the y direction.

19. The method of claim 13, wherein computing a set of texture addressing coordinates for the two dimensional rectangular object comprises:

setting a texture addressing coordinate u for a bottom left hand corner of the two dimensional rectangular object to be equal to the offset in the x direction divided by the dimension of the desktop display surface in the x direction; and setting a texture addressing coordinate v for the bottom left hand corner of the two dimensional rectangular object to be equal to the offset in the y direction divided by the dimension of the desktop display surface in the y direction plus the inverse of the zoom factor.

20. The method of claim 13, wherein computing a set of texture addressing coordinates for the two dimensional rectangular object comprises:

setting a texture addressing coordinate u for a bottom right hand corner of the two dimensional rectangular object to be equal to the offset in the x direction divided by the dimension of the desktop display surface in the x direction plus the inverse of the zoom factor; and setting a texture addressing coordinate v for the bottom left hand corner of the two dimensional rectangular object to be equal to the offset in the y direction divided by the dimension of the desktop display surface in the y direction plus the inverse of the zoom factor.

21. A computer system, comprising:

a processor; and a memory comprising program instructions executable by the processor to: create a render target surface having substantially the same dimensions as the desktop display surface; cast the desktop display surface as a texture having the same dimensions as the desktop display surface; determine a set of vertices that define a two dimensional rectangular object having the same dimensions as the desktop display surface; render the two dimensional rectangular object by mapping at least a portion of the desktop display surface texture to the two dimensional rectangular object; calculate a texture addressing extent configured to determine the portion of the desktop display surface texture to be mapped to the two dimensional rectangular object; calculate a set of texture addressing offsets in the x and V directions configured to provide the position on the desktop display surface texture from which the desktop display surface texture is to be mapped to the two dimensional rectangular object, wherein the texture addressing offset in the x direction is calculated as the offset in the x direction divided by the dimension of the desktop display surface in the x direction and the texture addressing offset in the y direction is calculated as the offset in the y direction divided by the dimension of the desktop display surface in the y direction; and set the render target surface as a scanout read location in preparation for displaying the desktop display surface.

22. The method of claim 21, wherein the memory further comprises program instructions executable to:

store the rendered two dimensional rectangular object to the render target surface; and scan out the rendered two dimensional rectangular object from the render target surface.

* * * * *